US011094429B2

(12) United States Patent
Hunter et al.

(10) Patent No.: US 11,094,429 B2
(45) Date of Patent: Aug. 17, 2021

(54) NON-METALLIC CABLE HAVING PCS SUBASSEMBLY

(71) Applicant: Cerro Wire LLC, Hartselle, AL (US)

(72) Inventors: Christel Hunter, Las Vegas, NV (US); Chad Braunecker, Sellersburg, IN (US)

(73) Assignee: CERRO WIRE LLC, Hartselle, AL (US)

( * ) Notice: Subject to any disclaimer, the term of this patent is extended or adjusted under 35 U.S.C. 154(b) by 0 days.

(21) Appl. No.: 16/432,546

(22) Filed: Jun. 5, 2019

(65) Prior Publication Data

US 2019/0371490 A1 Dec. 5, 2019

Related U.S. Application Data

(60) Provisional application No. 62/680,884, filed on Jun. 5, 2018.

(51) Int. Cl.

| | |
|---|---|
| ***H01B 7/02*** | (2006.01) |
| ***H01B 7/18*** | (2006.01) |
| ***H01B 7/00*** | (2006.01) |

(52) U.S. Cl.

CPC ..... *H01B 7/0225* (2013.01); *H01B 7/0009* (2013.01); *H01B 7/1805* (2013.01)

(58) Field of Classification Search

CPC ... H01B 7/02; H01B 7/04; H01B 7/06; H01B 7/0225; H01B 7/009; H01B 7/1805

USPC ..... 174/110 R, 112, 115, 120 R, 120 C, 174/121 R, 121 SR

See application file for complete search history.

(56) References Cited

U.S. PATENT DOCUMENTS

| | | | | |
|---|---|---|---|---|
| 5,025,115 | A * | 6/1991 | Sayegh | H01B 7/0823 174/117 F |
| 5,053,583 | A * | 10/1991 | Miller | H01B 11/20 174/36 |
| 5,180,890 | A * | 1/1993 | Pendergrass | G02B 6/4404 174/117 F |
| 5,342,991 | A * | 8/1994 | Xu | H01B 7/0823 174/115 |
| 6,127,632 | A * | 10/2000 | Oswald | H01B 7/046 174/120 R |
| 6,734,364 | B2 * | 5/2004 | Price | H01B 7/0853 174/113 C |
| 6,844,500 | B2 * | 1/2005 | Williams | H01B 7/0823 174/110 R |
| 7,667,140 | B2 * | 2/2010 | Hock | H01B 7/0876 174/117 F |
| 9,922,756 | B1 * | 3/2018 | Smith | H01B 13/144 |
| 2005/0180725 | A1 * | 8/2005 | Carlson | H01B 7/1885 385/147 |
| 2008/0217044 | A1 * | 9/2008 | Carlson | H01B 7/1885 174/113 R |

(Continued)

*Primary Examiner* — William H. Mayo, III

(74) *Attorney, Agent, or Firm* — Levenfeld Pearlstein, LLC

(57) ABSTRACT

A non-metallic cable includes at least two circuit conductors each disposed within a first insulator, a grounding conductor, and a first jacket in which the at least two circuit conductors and the grounding conductor extend. The non-metallic cable further includes two control conductors, each control conductor disposed within a second insulator, and a second jacket made from a thermoplastic material in which the two control conductors extend. The first jacket is connected to the second jacket.

18 Claims, 3 Drawing Sheets

(56) References Cited

U.S. PATENT DOCUMENTS

| | | | | |
|---|---|---|---|---|
| 2014/0241677 | A1* | 8/2014 | Sutehall | B29D 11/00701 385/104 |
| 2015/0034381 | A1* | 2/2015 | Harwath | H01B 7/0823 174/70 R |

* cited by examiner

NON-METALLIC CABLE HAVING PCS SUBASSEMBLY

CROSS-REFERENCE TO RELATED APPLICATION DATA

This application claims the benefit of and priority to Provisional U.S. Patent Application Ser. No. 62/680,884, filed Jun. 5, 2018, titled, Non-Metallic Cable Assembly Having PCS Subassembly, the disclosure of which is incorporated herein in its entirety.

BACKGROUND

The present disclosure relates generally to a non-metallic cable having a power or circuit conductor, and a signal or control, conductor subassembly.

A non-metallic (NM) cable refers to a cable having a non-metallic sheath in which insulated power conductors are disposed. In a known non-metallic cable, the non-metallic sheath is made from polyvinyl chloride (PVC). The insulation is made from color-coded PVC rated 90° C. dry with clear nylon (polyamide). The conductors may be solid conductors or stranded conductors. Solid conductors may be made from soft, uncoated copper per ASTM-B3. Stranded conductors may be made from uncoated copper per ASTM-B3 and ASTM B8. The NM cable may also include a grounding conductor made from soft, uncoated copper per ASTM-B3.

The NM cable may be a two-conductor construction having the insulated conductors laid parallel with the grounding conductor. The entire construction may then be wrapped with a paper and the sheath, or jacket, may be applied over the conductors. A three-conductor construction may have insulated conductors twisted together or laid parallel to each other. The grounding conductor is wrapped with paper and twisted together or laid parallel to the insulated conductor.

The conventional NM cable is used primarily in residential wiring, including branch circuits for outlets, switches, and the like. The NM cable may be installed in both exposed and concealed work in normally dry locations, such as air voids of masonry block or tile walls where these walls are not subject to excessive moisture or dampness. The NM cable will have conductors insulated with a rating of 90° C., but with the ampacity limited to that of 60° C. conductors. The conductors in the NM cable are power, or circuit, conductors for supplying or transmitting electricity. However, known NM cables do not include control, or signal, conductors configured for transmitting control signals or data.

Another known cable is a metal clad armor (MC) cable, having an outer sheath or jacket made from a metallic material. The MC cable includes power conductors and control conductors, as well as a grounding conductor. However, because of the metallic jacket, the MC cable may be more difficult to work with than the NM cable in certain applications, and may require specialized tools for some applications. In addition, the MC cable may also be more expensive than the NM cable.

Accordingly, it is desirable to provide a non-metallic cable having power conductors and control conductors that is suitably durable.

SUMMARY

According to one embodiment, a non-metallic cable includes at least two circuit conductors each disposed within a first insulator, a grounding conductor, and a first jacket in which the at least two circuit conductors and the grounding conductor extend. The non-metallic cable further includes two control conductors, each control conductor disposed within a second insulator, and a second jacket made from a thermoplastic material in which the two control conductors extend. The first jacket is connected to the second jacket.

In one embodiment, the first and second jackets may be connected to one another by way of the second jacket extending within the first jacket. In another embodiment, the first and second jackets may be connected to one another by way of a web or similar connecting technique or mechanism.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
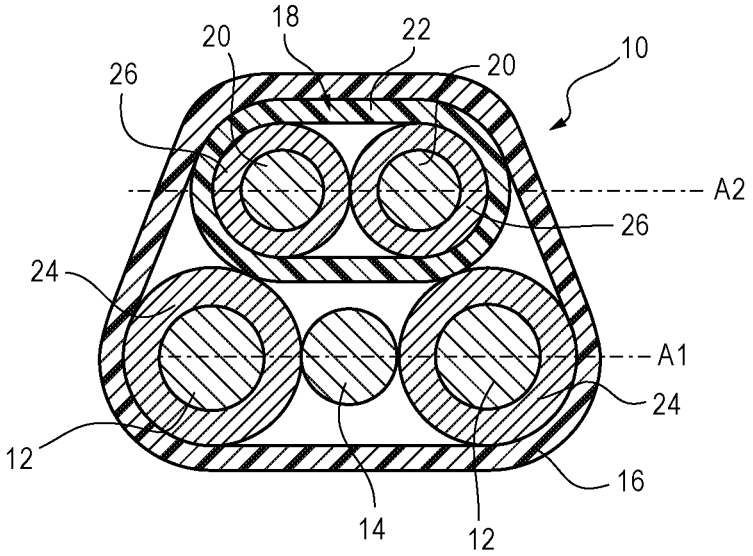
FIG. 1 is a diagram representing a cross-sectional view of a non-metallic cable according to an embodiment described herein.

FIG. 1 is a diagram representing a cross-sectional view of a non-metallic (NM) cable 10 having a control conductor subassembly 18 (also referred to herein as the PCS subassembly) according to an embodiment described herein. Thus, the cable 10 may be referred herein as an "NM-PCS cable." The NM-PCS cable 10 includes, generally, at least two circuit conductors 12 and a grounding conductor 14 disposed within a first jacket 16, and the PCS subassembly 18 connected to the first jacket 16. The PCS subassembly 18 includes two control conductors 20 disposed within a second jacket 22. In one embodiment, each circuit conductor 12 may be covered or encased by a first insulator 24. In addition, according to one embodiment, each control conductor 20 may be covered or encased by a second insulator 26. Each circuit conductor 12 is configured to carry, or transmit, an electrical current to provide power to an end load (not shown). Each control conductor 20 is configured to carry, or transmit, control signals or data, for example, to control operation(s) of the end load.

Referring to FIG. 1, the circuit conductor 12 may be, for example, copper, aluminum or copper-clad aluminum. Other suitable materials are envisioned as well. The circuit conductors 12 may be between 14 American Wire Gauge (AWG) and 10 AWG. For example, where the circuit conductors 12 are made from copper, the circuit conductors 12 are formed between 14 AWG and 10 AWG. In another embodiment, where the circuit conductors 12 are made from aluminum, the circuit conductors 12 may be between 12 AWG and 10 AWG.

In one embodiment, the grounding conductor 14 is configured to space apart or isolate the circuit conductors 12 from one another. In one embodiment, the grounding conductor 14 may be bare (i.e., not insulated). In another embodiment, the grounding conductor 14 is insulated. The circuit conductors 12 and the grounding conductor 14 may be laid parallel to one another, for example, with the grounding conductor 14 extending between the circuit conductors 12. In another embodiment, the circuit conductors 12 and the grounding conductor 14 may be cabled having a predetermined lay length. In one embodiment, the NM-PCS cable 10 includes at least two, but not more than four, circuit conductors 12.

The first jacket 16 is made from a thermoplastic material and is flexible. In on embodiment, the first jacket 16 may have a thickness of about 30 mils (0.76 mm) nominal, and in another embodiment, a thickness of at least 30 mils.

The first insulator 24 may be, for example, nylon or other similar, suitable material. In one embodiment, the first insulator 24 may be configured to comply with type THHN thermoplastic-insulated wire without any surface marking of THHN, -B or any ampacity or temperature rating. Alternatively, the first insulator 24 may be configured to comply with thickness parameters of a TW thermoplastic insulated wire. In another embodiment, the first insulator may be PVC, such as, but not limited to, a dry-location PVC, that complies with type THHN insulation. However, it is understood that insulating materials other than nylon and PVC are envisioned as well, such as other thermoplastic materials. In one embodiment, the first insulator 22 is made from PVC and nylon.

With further reference to FIG. 1, in one embodiment, the circuit conductors 12 may be positioned relative to one another such that a first transverse axis A1 extends through the at least two circuit conductors 12. For example, the first axis A1 may extend through respective centers of the at least two circuit conductors 12. Further still, in one embodiment, the first axis A1 may extend through the grounding conductor 14, and optionally, through a center of the grounding conductor 14.

Referring still to FIG. 1, the control conductors 20 may be made from, for example, copper, and may be between 18 AWG and 16 AWG. The second insulator 26 may be PVC, such as a dry location PVC that, in one embodiment, complies with Type TFN insulation and does not have any surface marking the ampacity or temperature rating. Additionally, in one embodiment, a tensile strength and elongation of the second insulator 26 may comply with the "Physical properties of PVC insulation from Type TFN and TFFN fixture wires" Table (Table 50.155) as set forth in UL 1581. A deformation test may be conducted at 121.0±1.0° C. (249.8±1.8° F.) with a decrease of not more than 50 percent in the thickness of the PVC insulation. The force to be used is 300 grams for 18 AWG and 400 grams for 16 AWG conductors.

In one embodiment, the second jacket 22 is made from a thermoplastic material and is flexible. The PCS subassembly 18 may be connected to the first jacket 16 by a number of different, suitable techniques. For example, with reference to FIG. 1, in one embodiment, the PCS subassembly 18 is housed in the first jacket 16. That is, the second jacket 22, having the two control conductors 20 extending therein, is disposed within the first jacket 16. The second jacket 22 is configured to space or isolate the two control conductors 20 from the at least two circuit conductors 12, also disposed in the first jacket 16. In one embodiment, the second jacket 22 may have a thickness of about 30 mils (0.76 mm) nominal, and in another embodiment, a thickness of at least 30 mils.

Thus, the second jacket 22 is configured to provide suitable protection, e.g., durability and resistance to wear or damage during installation and normal use of the NM-PCS cable 10, to the insulated control conductors 20, for example, by way of a combined thickness of the first and second jackets 16, 22. In one embodiment, the combined thickness of the first and second jackets 16, 22 may be about 60 mils, or greater.

Accordingly, in the embodiments above, the first jacket 16 extends around and encloses the circuit conductors 12, the grounding conductor 14 and the PCS subassembly 18 (including the second jacket 16 and the control conductors 20), thereby connecting or joining the circuit conductors 12 and the control conductors 20 as a single NM-PCS cable 10. The NM-PCS cable 10 is configured for installation in Class 2 and Class 3 circuits in accordance with Article 725 of the National Electric Code (NEC).

In one embodiment, the control conductors 20 may be positioned relative to one another such that a second transverse axis A2 extends therethrough. In one embodiment, the second axis A2 extends through respective centers of each control conductor 20. Referring to FIG. 1, in one embodiment, the control conductors 20 may be positioned relative to the circuit conductors 12 such that the first axis A1 and the second axis A2 extend parallel, or substantially parallel to one another. Such a configuration of the NM-PCS cable 10 may be referred to as a round configuration or round NM-PCS cable 10. The present disclosure is not limited to the relative positioning of the first and second axes A1, A2 above, however. For example, in one embodiment, the first and second axes A1, A2 may extend non-parallel to one another, but do not intersect at a location that is within the cable 10 (for example, within the first jacket 16) when the cable 10 is viewed in cross-section in its axial direction.

Figure 2:
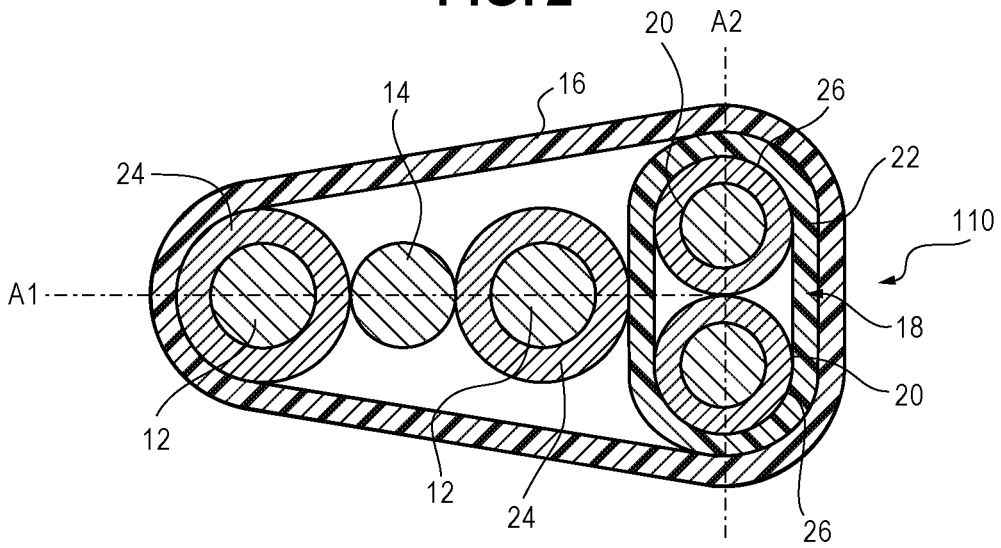
FIG. 2 is a diagram representing a cross-sectional view of a non-metallic cable according to another embodiment.

FIG. 2 is a diagram representing a cross-section of an NM-PCS cable 110 in a second configuration, according to another embodiment. The components of the NM-PCS cable 110 are formed the same, or substantially the same as the components of the NM-PCS cable 10 of FIG. 1, unless described otherwise below. However, in the NM-PCS cable 110 of FIG. 2, the PCS subassembly 18 is positioned differently relative to the circuit conductors 12 than in the embodiment of FIG. 1. For example, in the NM-PCS cable 110 of the embodiment shown in FIG. 2, the insulated control conductors 20 and the second jacket 22, i.e., the PCS subassembly 18, are positioned relative to the circuit conductors 12 such that the first axis A1 and the second axis A2 intersect. In one embodiment, the first axis A1 and the second axis A2 may extend perpendicular or substantially perpendicular to one another. Such a configuration, i.e., the configuration shown in FIG. 2, may be referred to as a flat configuration or a flat NM-PCS cable 110. In one embodiment, the first axis A1 intersects the PCS subassembly 18.

In one embodiment, the circuit conductors 12 and the control conductors 20 may extend substantially parallel to one another along individual, respective conductor axes or paths. In one embodiment, the circuit conductors 12 and the control conductors 20 do not extend coaxially with one another and are not positioned about a common axis. For example, in one embodiment, the circuit conductors 12 and the control conductors 20 are not positioned along generally circular paths having a common center when viewed in the axial direction.

Referring still to FIG. 2, in one embodiment, the flat NM-PCS cable 110 may include the insulated circuit conductors 12 and the grounding conductor 14 disposed between the circuit conductors 12. The circuit conductors 12 and the grounding conductor 14 may be positioned on the first axis A1 as described above. The flat NM-PCS cable 110 may also include the PCS subassembly 18, which includes the insulated control conductors 20 disposed in the second jacket 22. The insulated control conductors 20 may be positioned on the second axis A2, also described above. In the flat configuration, the first and second axes A1, A2 intersect each other.

Figure 3:
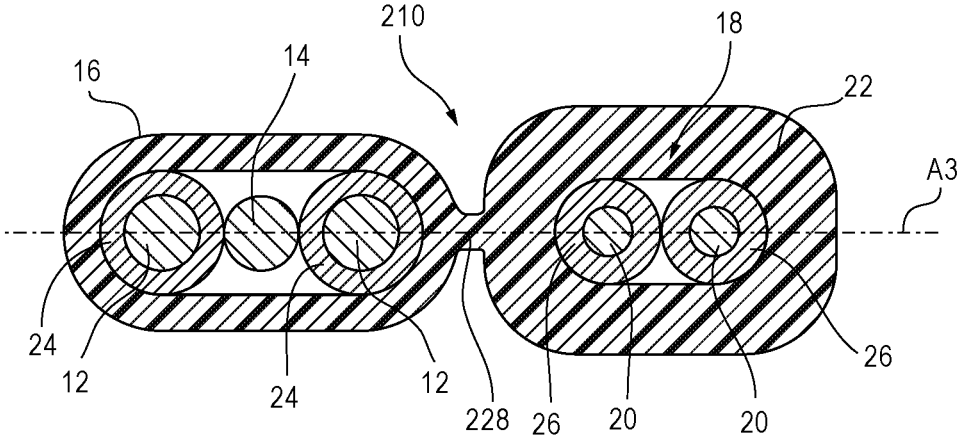
FIG. 3 is a diagram representing a cross-sectional view of a non-metallic cable according to another embodiment.
Figure 4A:
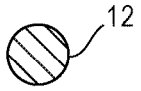
FIGS. 4A-4G show diagrams of various components, individually, and in different states of assembly, of the non-metallic cables of FIGS. 1-3, according to embodiments described herein.
Figure 4B:
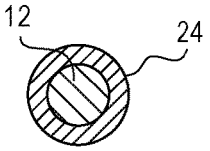
Figure 4C:
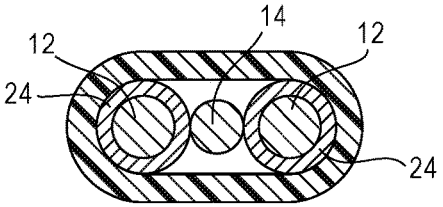
Figure 4D:
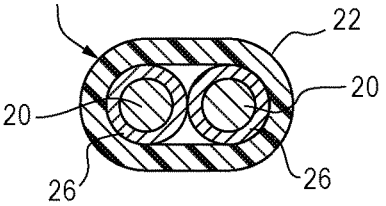
Figure 4E:
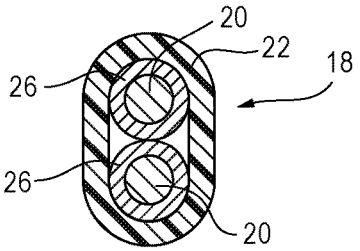
Figure 4F:
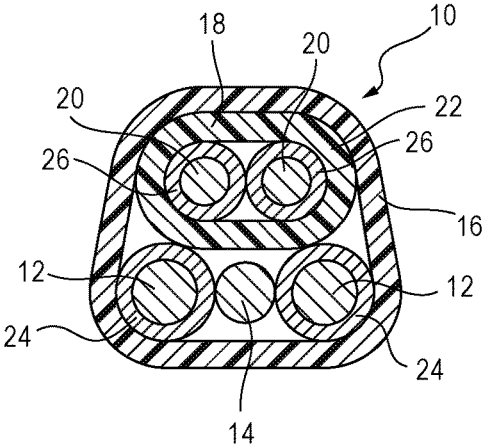
Figure 4G:
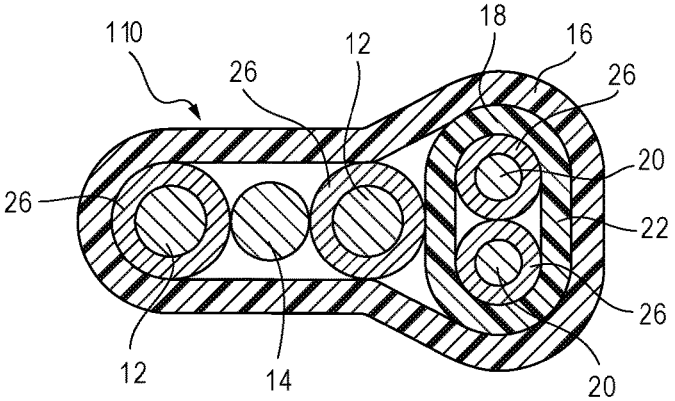

FIG. 3 is a diagram showing an NM-PCS cable 210 according to another embodiment. The components of the NM-PCS cable 210 are formed the same, or substantially the same as the components of the NM-PCS cable 10, 110 of FIGS. 1 and 2, above, unless otherwise described below. That is, the NM-PCS cable 210 of the embodiment shown in FIG. 3 generally includes the at least two circuit conductors 12, the grounding conductor 14, the first jacket 16 and the PCS subassembly 18 comprising the two control conductors 20 and the second jacket 22. The first and second insulators 24, 26 may be included for insulating the circuit conductors 12 and the control conductors 20, respectively. The NM-PCS cable 210 additionally includes a web 228 connected between the first jacket 16 and the second jacket 22. Accordingly, the embodiment of the NM-PCS cable 210 shown in FIG. 3, the PCS subassembly 18 is connected to the first jacket 16 with the web 228.

With further reference to FIG. 3, in one embodiment, the circuit conductors 12, grounding conductor 14 and the control conductors 20 may lie on a common transverse axis A3. In one embodiment, the common transverse axis A3 may extend through respective centers of the circuit conductors 12, grounding conductor 14 and control conductors 20. Further, in one embodiment, the web 228 may also lie on the common transverse axis A3, and optionally, may be bisected by the axis A3. However, the present disclosure is not limited to such a configuration, and it is understood that one or more of the circuit conductors 12, grounding conductor 14, web 228 and control conductors 20 may be offset or staggered relative to a transverse axis A3.

Still referring to FIG. 3, according to one embodiment, the second jacket 22 may be formed having a thickness of about 60 mils nominal, and in another embodiment, having a thickness of at least 60 mils. Accordingly, in the embodiments shown and described with reference to FIGS. 1-3, the control conductors 20 are enclosed by about or at least 60 mils of jacket material. For example, as described above with reference to FIGS. 1 and 2, the combined thickness of the first and second jackets 16, 22 is about or at least 60 mils. In the embodiment of the FIG. 3, with the second jacket 22 being positioned externally of the first jacket 16, the thickness of the second jacket 22 alone is about or at least 60 mils. Accordingly, suitable protection against wear or damage to the control conductors 20 may be provided in the embodiments of FIGS. 1-3.

Thus, in the embodiments above, the NM-PCS cable 10, 110, 210 may generally include two or more circuit conductors 12 and a grounding conductor 14, a first jacket 16 in which the circuit conductors 12 and grounding conductor 14 extend, and a PCS subassembly 18. The PCS subassembly 18 generally includes two control conductors 20 and a second jacket 22 in which the control conductors 20 extend. First and second insulators 24, 26 may insulate the circuit conductors 12 and the control conductors 20, respectively. The first and second jackets 16, 22 may be made of flexible, non-metallic, materials. In addition, the PCS subassembly 18 is connected to the first jacket 16 to form the NM-PCS cable 10, 110, 210. For example, in one embodiment, the PCS subassembly 18 may extend within the first jacket 16. In such an embodiment, the first jacket 16 serves as an outer, or overall, jacket in which the circuit conductors 12, grounding conductor 14, control conductors 20 and second jacket 22 extend. The second jacket 22 spaces apart and separates the control conductors 20 from the circuit conductors 12 within the first jacket 16. In another embodiment, the PCS subassembly 18 may be connected to the first jacket 16 by way of a web 228 interconnected between the first jacket 16 and second jacket 22. In one embodiment, the first jacket 16, second jacket 22 and web 228 may be formed as a continuous, integral, one-piece construction, for example, in a molding process. Other, or additional, suitable connections between the first jacket 16 and second jacket 22 are envisioned as well, including known fastening techniques such as adhesives, heat sealing, welding and/or known, suitable mechanical fasteners, such as clamps, bands and the like. In one embodiment, the circuit conductors 12 and the PCS subassembly 18 may be connected in parallel with one another.

In addition, the NM-PCS cable 10, 110 may be formed as a round NM-PCS cable 10 (FIG. 1) or a flat NM-PCS cable 110 (FIG. 2). In one embodiment, the second jacket 22, and in turn the PCS subassembly 18, may be connected to the circuit conductors 12 by the web 228 or similar method (FIG. 3). The second jacket 22 may have a thickness of about 30 mils nominal, and in one embodiment, no less than 30 mils, and in at least one embodiment, about 60 mils nominal, and optionally no less than 60 mils.

Features from any one of the embodiments described above may be implemented in, combined or used together with, or replace features from any of the other embodiments described above.

Accordingly, in the embodiments above, a non-metallic cable may be formed having a control conductor subassembly together with circuit conductors, to provide power, control and signal functionality. Because the NM-PCS cables 10, 110, 210 incorporate the flexible thermoplastic jacket(s), the NM-PCS cables 10, 110, 210 described herein retain flexibility and workability characteristics commonly associated with conventional NM cables. Further, at least in part due to the configurations of the flexible jacket(s) described above, the NM-PCS cables 10, 110, 210 described herein may be sufficiently durable and resistant to wear and damage to allow for reliable operation of the control conductors 20.

The NM-PCS cables 10, 110, 210 may be tested according to several testing methods. For example, the NM-PCS cables 10, 110, 210 of the embodiments described herein, may be configured such that when tested in accordance with section 7.6 of UL 719, a vertical specimen of the finished cable 10, 110, 210 the PCS subassembly 18, and the individual insulated control conductors 20 do not flame longer than 60 seconds following five 15 second applications of a test flame with a period of 15 seconds between each application of the test flame. Such a test may be used to determine whether any wire, cable or PCS subassembly is capable of conveying flame along its length or to combustible materials in its vicinity.

The round NM-PCS cable 10 may be tested for crushing resistance in accordance with the method described in the Crushing-Resistance Test of Round Type NM Cables Section of the Reference Standard for Electrical Wires, Cables and Flexible Cords, in UL 1581. For example, an average of ten crushing trials may be used to determine if the cable is acceptable. In one embodiment, the determination is based on whether the average of the ten trials is less than 1200 lbf/5388 N/544 kgf.

In one embodiment, the jacket on a conventional flat NM cable containing two or three copper circuit conductors at 14 or 12 AWG, or aluminum insulated circuit conductors at 10 or 12 AWG should not wear through exposing the underlying protective shear or conductor assembly in fewer than 70 complete cycles of abrasion again sharp steel edges. In the flat NM-PCS cable 110 of the embodiments herein, the control conductors 20 may be separated from the circuit conductor side and only the remaining portion of the circuit conductor (NM cable) may be subjected to this test.

The NM-PCS cables 10, 110, 210 according to an embodiment, are constructed to withstand low-temperature pulling through joists without an opening being formed in the jacket that would expose the cable interior, without reduction in spacing between the circuit conductors 14 to less than a predetermined threshold value, without a change in the position of the grounding conductor 16 that would result in a metal material of the grounding conductor 16 touching insulation on a circuit, and without physical damage to the insulation. In one embodiment, holes in the joist through which the NM-PCS cables 10, 110, 210 may be pulled through are formed having a size or diameter measuring 1 in., and are not smoothed or rounded to remove splinters, sawdust, drilling chips and the like.

In still another embodiment, the NM-PCS cables 10, 110, 210 may carry the "-PCS" suffix to designate the presence of Class 2 or Class 3 control conductors 20. In a round NM-PCS cable 10, the second jacket 22 may be marked to indicate that the conductors 20 are for signal or control connections and not for circuit power. The first jacket 16 may be marked to indicate that the NM-PCS cable 10 contains control conductors 20 and circuit conductors 12. In one embodiment, the markings may be repeated along the length of cable 10, for example, at intervals of 24 in. or 610 mm.

According to another embodiment, in the flat NM-PCS cable 110 comprising a separately jacketed control conductor 20 construction having a thickness of about 60 mils, the jacket over the control conductors 20, i.e., the second jacket 22, may be marked to indicate that the conductors under the jacket are only for signal or control connections and not for circuit power. The markings may be repeated along the length of the cable, for example, at intervals of 24 in. or 610 mm. Another marking to indicate that both the control conductors 20 and the circuit conductors 12 are provided in the cable 10, that the control conductors 20 are not be used as circuit conductors, and that the control conductors 20 are under a jacket marked as such, may be provided on a tag, reel or carton of the NM-PCS cable 110.

In another embodiment, the NM-PCS cable 10, 110, 210 described in the embodiments above may be used in underground feeder (UF) applications, and thus, may be referred to as a UF-PCS cable. The UF-PCS cable of the present disclosure differ from a conventional UF cable listed to UL standard 493 in that the UF-PCS cable described herein includes the PCS subassembly 18.

The NM-PCS cables 10, 110, 210 described in the embodiments above may be similar to NM cables listed to UL 719. However, the NM-PCS cables 10, 110, 210 described herein differ from the UL 719 cable at least in that the NM-PCS cables 10, 110, 210 described herein include the PCS subassembly 18.

FIGS. 4A-4G show various views of the components of the NM-PCS cables 10, 110, 210 of FIGS. 1-3, individually, and in various states of assembly, according to an embodiment. The components may be sized according to different cable sizes, such as 14N/18P, 12N/18P, 12N/16P, and 10N/16P. It is understood that some reference numbers and lead lines are omitted for clarity, so long as a like component is identified elsewhere in the figure.

It is understood the various features from any of the embodiments above are usable together with the other embodiments described herein.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. In addition, it is understood that terminology referring to orientation of various components, such as "upper" or "lower" is used for the purposes of example only, and does not limit the subject matter of the present disclosure to a particular orientation.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A non-metallic cable comprising:

at least two circuit conductors each disposed within a first insulator;

a grounding conductor, the grounding conductor disposed between the at least two circuit conductors;

a first jacket in which the at least two circuit conductors and the grounding conductor extend;

two control conductors, each control conductor disposed within a second insulator, the control conductors disposed adjacent one another; and a second jacket made from a thermoplastic material in which the two control conductors extend, wherein the first jacket is connected to the second jacket.

2. The non-metallic cable of claim 1, wherein the at least two circuit conductors comprise no more than four circuit conductors.

3. The non-metallic cable of claim 1, wherein the circuit conductors are made from copper, aluminum or copper-clad aluminum.

4. The non-metallic cable of claim 1, wherein the first insulator is made from PVC or PVC and nylon.

5. The non-metallic cable of claim 1, wherein the circuit conductors are between 14 AWG and 10 AWG.

6. The non-metallic cable of claim 1, wherein the circuit conductors are laid parallel to one another.

7. The non-metallic cable of claim 1, wherein the second insulator is polyvinyl chloride (PVC).

8. The non-metallic cable of claim 1, wherein the control conductors are made from copper.

9. The non-metallic cable of claim 1, wherein the control conductors are between 16 AWG and 18 AWG.

10. The non-metallic cable of claim 1, wherein the circuit conductors and the control conductors extend parallel and are not positioned about a common longitudinal axis relative to one another.

11. The non-metallic cable of claim 1, wherein the second jacket extends within the first jacket to connect to the second jacket to the first jacket.

12. The non-metallic cable of claim 11, wherein the first and second jackets each have a thickness of 30 mils nominal or greater.

13. The non-metallic cable of claim 11, wherein the first and second jackets have a combined thickness of 60 mils nominal or greater.

14. The non-metallic cable of claim 11, wherein the circuit conductors are positioned such that a first transverse axis extends through the circuit conductors, and the control conductors are position such that a second transverse axis extends through the control conductors, wherein the first transverse axis intersects the second transverse axis.

15. The non-metallic cable of claim 11, wherein the circuit conductors are positioned such that a first transverse axis extends through the circuit conductors, and the control conductors are position such that a second transverse axis extends through the control conductors, wherein the first transverse axis and the second transverse axis are parallel or substantially parallel to one another.

16. The non-metallic cable of claim 1, further comprising a web interconnected between the first jacket and the second jacket to connect the first jacket to the second jacket.

17. The non-metallic cable of claim 16, wherein the second jacket has a thickness of 60 mils nominal or greater.

18. The non-metallic cable of claim 17, wherein the second jacket isolates the control conductors from the circuit conductors.

* * * * *